US006318328B1

(12) United States Patent
Hegemier

(10) Patent No.: US 6,318,328 B1
(45) Date of Patent: Nov. 20, 2001

(54) DRY VALVE STEM SEAL

(75) Inventor: Tim Hegemier, Avilla Noble, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/685,626

(22) Filed: Oct. 10, 2000

(51) Int. Cl.[7] ..... F01L 3/08
(52) U.S. Cl. ..... 123/188.6
(58) Field of Search ..... 123/188.6, 188.5; 277/502

(56) References Cited

U.S. PATENT DOCUMENTS

| | | | |
|---|---|---|---|
| 1,925,729 | | 9/1933 | Gits . |
| 2,081,040 | | 5/1937 | King . |
| 2,264,413 | | 12/1941 | Siegerist . |
| 2,509,436 | | 5/1950 | Isenbarger . |
| 3,306,621 | | 2/1967 | Fisher . |
| 3,480,286 | | 11/1969 | Kosatka . |
| 3,599,992 | | 8/1971 | Kammeraad . |
| 4,502,696 | | 3/1985 | Kammeraad . |
| 5,873,337 | * | 2/1999 | Binford ..... 277/502 |
| 6,006,778 | * | 12/1999 | Kim ..... 123/188.6 |
| 6,123,054 | * | 9/2000 | Netzer ..... 123/188.6 |
| 6,202,616 | * | 3/2001 | Gracyalny ..... 123/188.6 |
| 6,209,504 | * | 4/2001 | Hegemier et al. ..... 123/188.6 |

* cited by examiner

*Primary Examiner*—Marguerite McMahon
(74) *Attorney, Agent, or Firm*—Rader, Fishman & Grauer PLLC

(57) ABSTRACT

A valve stem seal assembly includes two annular hydraulic seals separated by a generally flat support member, where the seals are axially positioned back to back on an upper free end of a valve stem. The seals and the washer are secured along a radially outer circumference by a retainer, a lower portion of which contacts an upper surface of a valve guide. The valve stem is slideably sealed by an inner annular surface of both hydraulic seals.

18 Claims, 1 Drawing Sheet

DRY VALVE STEM SEAL

FIELD OF INVENTION

The present invention relates to a valve stem seal and more particularly to a seal that prevents oil flow down a valve stem toward a combustion chamber.

BACKGROUND OF THE INVENTION

In conventional overhead valve internal combustion engines, at least two valves reciprocate to provide intermittent communication between intake and exhaust manifolds and a combustion chamber. The valves include valve stems that are disposed in valve stem guides, supporting axial motion in an engine component such as an engine head. Lubrication is provided to upper portions of the valve stems by a spray of lubricating oil within a valve cover disposed over the engine head or by gravity flow from an associated rocker arm. Oil flows by the force of gravity and may be encouraged by a pressure differential in the manifold versus crankcase pressure along a free upper end of the valve stem toward the manifolds and valve heads.

Valve stem seals located between the valve stem and the valve guide serve various purposes. First, they minimize engine oil consumption by metering oil entry into the manifold and the combustion chamber. Second, they help to minimize exhaust particles that contribute to pollution. Third, they are helpful in minimizing guide wear.

However, increasingly stringent environmental protection regulation requires that vehicle emissions be reduced to produce lower pollution levels. Exhaust particles, as noted above, contribute to this pollution. Emission levels increase by allowing even minuscule amounts of oil past the valve stem seal and down the valve stem and into the combustion chamber. Current valve stem seals, however, are designed only to meter or limit oil flow and are incapable of completely eliminating oil flow down the valve stem and into a combustion chamber.

Accordingly, a valve stem seal is needed that prevents the flow of any oil down a valve stem past the valve guide and into the combustion chamber.

SUMMARY OF THE INVENTION

A valve stem seal assembly is provided to prevent oil flow down a valve stem into a combustion chamber that includes two annular hydraulic (zero-leak) seals separated by a generally flat support member, where the seals are axially positioned back to back on an upper free end of a valve stem. The seals and the washer are secured along a radially outer circumference by a retainer, a portion of which contacts an upper surface of a valve guide. The valve stem is slideably sealed by an inner annular surface of both seals.

Preferably, each hydraulic seal includes a generally U- or V-shaped radial cross-section formed by inner and outer legs separated by a radial transverse portion. The seal may include a support such as a spring in the radial cross-section of each seal. The spring provides an inwardly radial force to hold the seal in place against the valve stem while giving the seal assembly a longer life-span during reciprocation of the valve stem. When assembled, the transverse portions of each respective hydraulic seal are placed in adjacent relationship and are separated by the support member, such that the inner legs of each respective seal define upper and lower sealing lips that contact the valve stem, and such that the outer legs of each respective seal contact the retainer. The support member may be a rigid precision washer.

The upper sealing lip acts to prevent the flow of all overhead oil down the valve stem. In particular, the retainer provides sufficient radial pressure on the upper seal to cause the upper sealing lip to completely seal the valve stem against downward oil flow. Additionally, during reciprocating action of the valve, the upper sealing lip scrapes oil off the valve stem, collecting the oil within a U- or V-shaped reservoir portion of the upper seal such that the oil within the reservoir exerts a further radially inward pressure on the upper seal. Similarly, the lower sealing lip prevents pressure from the exhaust and intake manifolds from upsetting the sealing action of the upper seal. The upper and lower sealing lips thus combine to completely eliminate an oil leak path into the combustion chamber, thereby reducing harmful emissions.

BRIEF DESCRIPTION OF DRAWINGS

A number of features and advantages of the present invention will become apparent from the detailed description of the invention that follows and from the accompanying drawings, wherein.

DETAILED DESCRIPTION OF PREFERRED EMBODIMENTS

Figure 1:
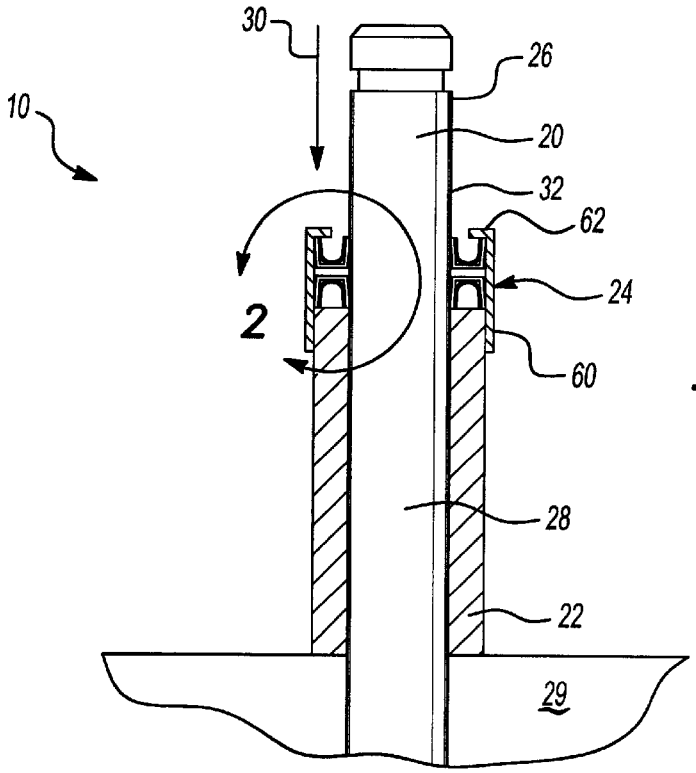
FIG. 1 is a cross sectional view of a valve stem seal according to the present invention.

A valve assembly 10 for use in an internal combustion engine is shown in FIG. 1 that includes a valve stem 20, a valve stem guide 22, and a valve stem seal 24. During operation of the engine, valve stem 20 is caused to reciprocate by an associated rocker arm assembly (not shown) or similar device. During reciprocating operation, an upper portion 26 of valve stem 20 is exposed to a spray or bath of lubricating oil. A lower portion 28 of valve stem 20 is supported by guide 22 as it extends through an engine head 29. Lower portion 28 is further connected to a valve head (not shown) that extends into a portion of a combustion chamber (not shown) for introducing or exhausting gasses.

Valve stem seal 24 is placed around the valve stem upper portion 26 to seal against oil flowing downwardly in the direction of arrow 30 along the outer surface 32 of the valve stem. Since even a minute amount of oil entering the combustion chamber increases harmful emissions, valve stem seal 24 is designed to prevent any oil from flowing downwardly along surface 32 through guide 22.

Figure 2:
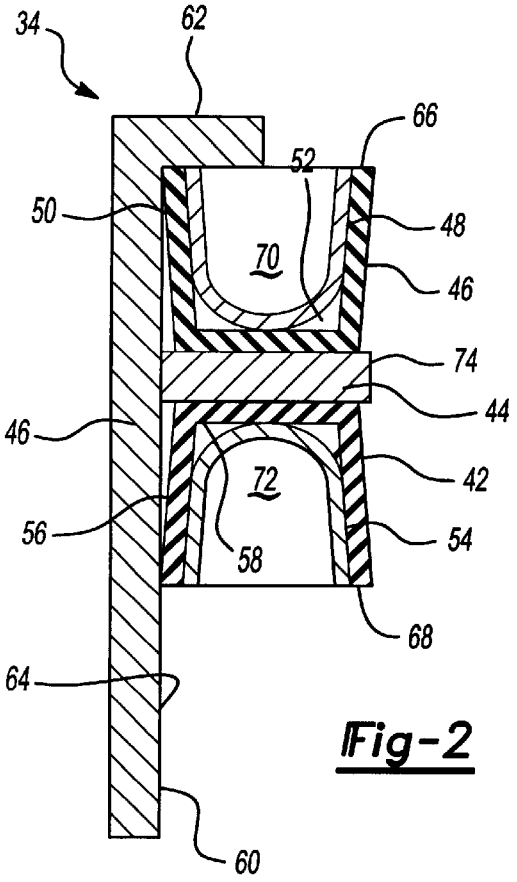
FIG. 2 is an enlarged detailed view of Circle A of FIG. 1 showing the positioning of the valve stem seal of the present invention.

Seal assembly 34 is shown in greater detail in FIG. 2. The seal assembly includes upper and lower hydraulic seals 40, 42 separated by a spacer member 44 and held in place by retainer 46. Upper seal 40 includes inner and outer legs 48, 50 separated by a radial transverse portion 52 to form a U- or V-shaped radial cross-section. Similarly, lower seal 42 includes inner and outer legs 54, 56 separated by a radial transverse portion 58 to form an inverted U- or V-shaped radial cross-section. If desired, seals 40, 42 may be formed of different materials. However, seals 40, 42 are preferably identical hydraulic seals oriented such that the respective radial transverse portions 52, 58 are aligned adjacent each other and rest upon opposite sides of spacer member 44. Spacer member 44 is preferably rigid, and may be a precision annular washer having an outer diameter slightly smaller than the outer diameter of each seal 40, 42.

The seals and the spacer member are held in place and the seals are compressed against valve stem surface 32 (see FIG. 1) by retainer 46. Retainer 46 also locates the valve seal assembly 34 in place along the valve stem. A lower portion 60 of retainer 46 engages an upper part of valve guide 22 (see FIG. 1), while an upper radially inwardly extending retainer upper portion 62 prevents longitudinal movement of the seals. Additionally, an annular inner surface 64 of retainer 46 contacts the outer circumference of seals 40, 42 and of member 44. Since the outer diameter of member 44 is slightly smaller than the outer diameter of the seals, the seals are compressed radially inwardly by retainer 46 towards the valve stem. With respect to upper seal 40, upper sealing lip 66 contacts surface 32 and acts to scrape oil off of the valve stem during reciprocation. With respect to lower seal 42, lower sealing lip 68 prevents pressure from the combustion chamber from upsetting the sealing action of upper sealing lip 66.

Seal assembly 34 is designed so that the sealing ability of the assembly improves during valve reciprocation. As stem 22 reciprocates, upper sealing lip 66 scrapes oil from the valve outer surface. As oil is scraped, it is collected in an oil reservoir 70 formed in the concave portion of upper seal 40. The constant extraction of oil from valve stem 22 causes the reservoir to fill. At the same time, retainer upper portion 62 covers at least a portion of the cross sectional area of the upper seal 40, acting as an obstruction against oil flow out of the reservoir. The U- or V-shape of upper seal 40 acts to convert the oil flow from directly longitudinal flow to a radial flow, and the retainer upper portion likewise converts flow from longitudinally upward to primarily radially inward, thereby increasing the radial pressure on the upper sealing lip 66. However, since the retainer upper portion 62 does not completely cover upper seal 40, a secondary flow of oil is allowed to escape from reservoir 70 through exposed cross sectional area of the upper seal. Thus, as more oil is scraped into reservoir 70, the radial pressure on the seal increases, thereby increasing the effectiveness of upper sealing lip 66.

Lower seal 42 serves to prevent pressure from the exhaust and intake manifolds from upsetting the sealing action of the upper seal. Pressure from the manifolds is collected in concave portion 72 of the lower seal and acts to exert radial pressure on the lower sealing lip 68 in the same way that oil in reservoir 70 exerts radial pressure on upper sealing lip 66. At the same time, the support member 44 prevents twisting of either the upper or lower seal, while preventing radial crushing of the retainer and seals. To allow free reciprocation of valve stem 20, the radially inner diameter of support member 44 is preferably greater than the outer diameter of the valve stem. However, radially inner surface 74 of member 44 may also include a low friction coating or the like to promote easy sliding of the valve stem past the support member.

Figure 3:
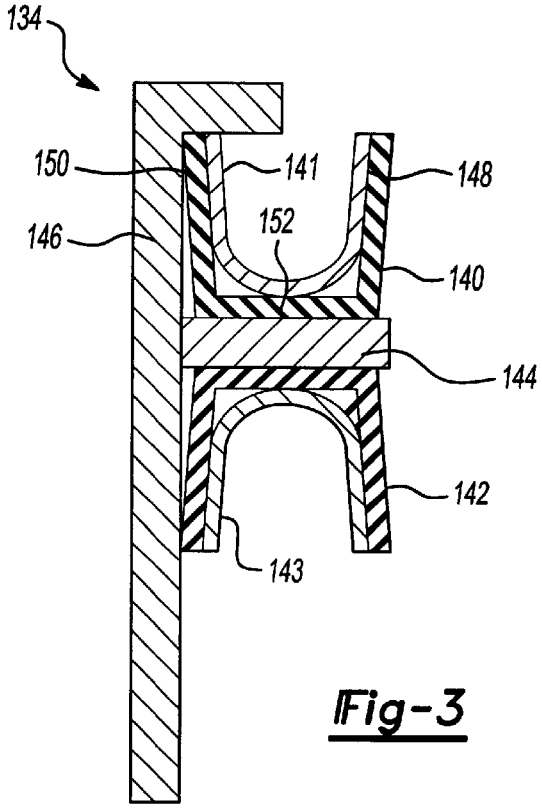
FIG. 3 is an enlarged detailed view of Code A of FIG. 1 showing a second embodiment of the valve stem seal assembly of the present invention.

A preferred embodiment of seal assembly 134 is shown in FIG. 3. The seal assembly includes upper and lower hydraulic seals 140, 142 separated by a spacer member 144 and held in place by retainer 146. Spring reinforcements 141, 143 may be positioned in the radial cross-section of upper and lower hydraulic seals 140, 142. Preferably, springs 141, 143 include a U- or V-shaped radial cross section such that legs 155, 157 of springs 141, 143 exert force in a radial outward and radial inward direction, respectively. However, springs 141, 143 may be of any type that exert at least a radially inward force. Once springs 141, 143 are positioned in the cross-section of seals 140, 142, the springs 141, 143 will force seals 140, 142 to conform to the shape of springs 141, 143. The sealing action of seals 140, 142 with the inclusion of preferred U- or V-shaped springs 141, 143 are selectively focused on inner and outer legs 148, 150 which are separated by a radial transverse portion 152 to form a U- or V-shaped radial cross-section. Springs 141 and 143 both provide a superior sealing action of upper and lower hydraulic seals 140, 142 by exerting a greater inward and outward radial force from legs 148, 150 upon surface 132 and retainer 146.

Instead of metering the oil flow past the valve guide, the valve stem seal assembly described above is designed to completely eliminate the oil leak path along the valve stem. Since oil flowing past the valve guide into the combustion chamber contributes significantly to harmful emissions, eliminating the oil flow entirely greatly reduces emissions while providing adequate sealing between the valve stem and the intake and exhaust manifolds. Although certain preferred embodiments of the present invention have been described, the invention is not limited to the illustrations described and shown herein, which are deemed to be merely illustrative of the best modes of carrying out the invention. A person of ordinary skill in the art will realize that certain modifications will come within the teachings of this invention and that such modifications are within its spirit and the scope as defined by the claims.

What is claimed is:

1. A zero-leak valve stem seal assembly, comprising:

upper and lower annular hydraulic seals separated by a generally flat annular support member, each said seal having a generally U-shaped radial cross section formed from a pair of spaced longitudinally extending legs and a radially extending transverse portion extending between said legs, wherein said seal transverse portions are located adjacent said support member; and a retainer contacting an outer circumference of said seals and said support member.

2. The valve stem seal assembly of claim 1, wherein said support member is a precision washer.

3. The valve stem seal assembly of claim 1, wherein an upper portion of said retainer extends radially inwardly to cover at least a portion of said upper seal.

4. The valve stem seal assembly of claim 3, wherein a lower portion of said retainer engages a valve guide.

5. The valve stem seal assembly of claim 4, wherein upper and lower resilient members are located within and engage the radial cross-section of said upper and lower seal.

6. The valve stem assembly of claim 5, wherein each resilient member is a spring having a U- or V-shaped radial cross section.

7. In a valve assembly of an internal combustion engine including a valve stem reciprocating within a valve guide, a seal for sealing the valve stem against oil flow through the valve guide comprising:

upper and lower annular hydraulic seals separated by a generally flat annular support member, each said seal having a generally U-shaped radial cross section formed from a pair of spaced longitudinally extending legs and a radially extending transverse portion extending between said legs to form a concave cavity therein, wherein said seal transverse portions are located adjacent said support member;

a pair of springs, each said spring located in the radial cross-section of said upper and lower seal; and a retainer contacting an outer circumference of said seals and said support member.

8. The seal of claim 7, wherein said support member is a precision washer.

9. The seal of claim 7, wherein an upper portion of said retainer extends radially inwardly to cover at least a portion of said upper seal cavity.

10. The seal of claim 9, wherein a lower portion of said retainer engages a valve guide.

11. The seal of claim 7, wherein an inner diameter of said support member is greater than an outer diameter of the valve stem.

12. The seal of claim 7, wherein said springs engage said legs and transverse portion of one of said upper and lower seal.

13. The seal of claim 7, wherein each spring is U-shaped.

14. A zero-leak valve stem seal assembly, comprising:

upper and lower annular hydraulic seals separated by an annular support member, each said seal having a generally U-shaped radial cross section formed from inner and outer longitudinally extending legs and a radially extending transverse portion extending between said legs, wherein said seal transverse portions contact said support member;

a pair of springs, each said spring located in the radial cross-section of said upper and lower seal; anda retainer contacting an outer circumference of said seals and said support member.

15. The stem seal assembly of claim 14, wherein said upper seal inner leg further includes an upper sealing lip in contact with a valve stem.

16. The stem seal of claim 14, wherein each spring engages said legs and transverse portion of one of said upper and lower seal.

17. The seal of claim 14, wherein each spring is U-shaped.

18. The stem seal assembly of claim 15, wherein an inner diameter of said support member is greater than an outer diameter of an associated valve stem.

* * * * *

UNITED STATES PATENT AND TRADEMARK OFFICE

CERTIFICATE OF CORRECTION

PATENT NO. : 6,318,328 B1
DATED : November 20, 2001
INVENTOR(S) : Tim Hegemier

It is certified that error appears in the above-identified patent and that said Letters Patent is hereby corrected as shown below:

Column 6,
Line 5, replace "seal; anda" with -- seal; and a --.

Signed and Sealed this

Second Day of April, 2002

*Attest:*

*Attesting Officer*

JAMES E. ROGAN
*Director of the United States Patent and Trademark Office*